US008403031B2

(12) United States Patent
Kühnel et al.

(10) Patent No.: US 8,403,031 B2
(45) Date of Patent: Mar. 26, 2013

(54) HEAT TRANSMISSION UNIT

(75) Inventors: Hans-Ulrich Kühnel, Monchengladblach (DE); Dieter Jelinek, Kaarst (DE); Peter Heuer, Pulheim (DE); Dieter Thonnessen, Viersen (DE)

(73) Assignee: Pierburg GmbH, Neuss (DE)

( * ) Notice: Subject to any disclaimer, the term of this patent is extended or adjusted under 35 U.S.C. 154(b) by 1039 days.

(21) Appl. No.: 12/293,156

(22) PCT Filed: Jan. 25, 2007

(86) PCT No.: PCT/EP2007/050720

§ 371 (c)(1),
(2), (4) Date: Feb. 27, 2009

(87) PCT Pub. No.: WO2007/104595

PCT Pub. Date: Sep. 20, 2007

(65) Prior Publication Data

US 2009/0183861 A1 Jul. 23, 2009

(30) Foreign Application Priority Data

Mar. 16, 2006 (DE) ..... 10 2006 012 219

(51) Int. Cl.
*F28F 27/02* (2006.01)

(52) U.S. Cl. ..... 165/96; 165/97; 165/100; 165/101; 165/103

(58) Field of Classification Search ..... 165/100, 165/137, 96, 97, 164, 165, 181, 103, 101; 123/568.12
See application file for complete search history.

(56) References Cited

U.S. PATENT DOCUMENTS

| | | | | | |
|---|---|---|---|---|---|
| 2,261,579 | A | * | 11/1941 | Booth | 165/41 |
| 3,990,504 | A | * | 11/1976 | Kolthoff, Jr. | 165/271 |
| 4,217,953 | A | * | 8/1980 | Sonoda et al. | 165/153 |
| 4,415,024 | A | | 11/1983 | Baker | |
| 4,971,137 | A | | 11/1990 | Thompson | |
| 5,417,280 | A | * | 5/1995 | Hayashi et al. | 165/153 |

(Continued)

FOREIGN PATENT DOCUMENTS

| | | |
|---|---|---|
| DE | 941 033 C | 3/1956 |
| DE | 29 41 721 A1 | 4/1981 |

(Continued)

OTHER PUBLICATIONS

Office Action issued in corresponding German Application No. 10 2006 012 219.4-13, dated Dec. 1, 2006.

(Continued)

*Primary Examiner* — Leonard R Leo
(74) *Attorney, Agent, or Firm* — Norman B. Thot

(57) ABSTRACT

A heat transmission unit includes a channel conducting a coolant, and a channel conducting a fluid to be cooled. The two channels are separated from each other by a wall provided with ribs extending therefrom into at least one of the two channels. The channel conducting the fluid to be cooled includes a fluid inlet and a fluid outlet. The channel is separated by a partition wall, arranged in flow direction, into a first and a second partial channel having a first partial inlet for fluid and a second partial inlet for fluid, and a first partial outlet for fluid and a second partial outlet for fluid. At least the first partial inlet for fluid is adapted to be shut off by a first shut-off device.

4 Claims, 3 Drawing Sheets

U.S. PATENT DOCUMENTS

| | | | | |
|---|---|---|---|---|
| 5,732,688 | A | 3/1998 | Charlton et al. | |
| 6,070,657 | A * | 6/2000 | Kunkel | 165/183 |
| 7,243,707 | B2 * | 7/2007 | Brost et al. | 165/103 |
| 2005/0235973 | A1 | 10/2005 | Husges | |

FOREIGN PATENT DOCUMENTS

| | | | |
|---|---|---|---|
| DE | 31 03 198 | A1 | 8/1982 |
| DE | 35 08 240 | A1 | 9/1986 |
| DE | 10 2004 019 554 | A1 | 11/2005 |
| DE | 10 2004 025 187 | B3 | 11/2005 |
| EP | 1626238 | A1 | 2/2006 |
| JP | 58 035397 | A | 3/1983 |
| JP | 60-050225 | | 3/1985 |
| WO | 2004/036134 | A | 4/2004 |

OTHER PUBLICATIONS

International Search Report issued in corresponding application No. PCT/EP2007/050720 completed Apr. 25, 2007, mailed May 4, 2007.

* cited by examiner

HEAT TRANSMISSION UNIT

This is a National Phase Application in the United States of International Patent Application No. PCT/EP2007/050720 filed Jan. 25, 2007, which claims priority on German Patent Application No. 10 2006 012 219.4, filed Mar. 16, 2006. The entire disclosures of the above patent applications are hereby incorporated by reference.

The present invention relates to a heat transmission unit comprising a channel conducting a coolant, and a channel conducting a fluid which is to be cooled, said two channels being separated from each other by a wall provided with ribs extending therefrom into at least one of said two channels.

BACKGROUND OF THE INVENTION

Heat transmission units of the above type are used e.g. for the cooling of exhaust gases in an exhaust-gas recirculation line of an internal combustion engine. In such an arrangement, the ribs normally extend into the channel conducting the fluid which is to be cooled. In this regard, there exist variants wherein the ribs extend into the channel from both of the opposite sides of the heat transmission unit, as well as variants wherein the ribs extend into the channel only from one side. The ribs can have various shapes and they can extend as one-pieced ribs along the main flow direction or be formed as individual ribs; known ribs include pin- and tube-shaped ribs as well as airfoil-shaped ribs.

The channel conducting the coolant can be arranged within the fluid-conducting channel, or it can surround the fluid-conducting channel when seen in cross section.

In internal combustion machines, heat transmission units are used for the cooling of e.g. air, exhaust gas or lubricating oil. Thus, for instance, charge-air coolers are used for cooling the combustion temperatures and thus also the resultant nitrogen oxides, and exhaust-gas coolers are used for heating the air in order to warm up an occupant cell more quickly, or they are used in the exhaust-gas line in order to reduce the exhaust-gas temperature of a gas flowing towards a catalyst. In exhaust-gas recirculation lines, the exhaust-gas temperatures and thus the combustion temperature in the engine are reduced with the aid of the exhaust-gas cooler, which in turn will allow for a reduction of pollutant emissions. In each of the above cases, the cooling water of the internal combustion engine can serve as a coolant.

A heat transmission unit arranged in an exhaust-gas recirculation system of an internal combustion engine is known e.g. from DE 10 2004 019 554 A1. This unit comprises a channel conducting the exhaust gas along a U-shaped path and being surrounded along its whole cross section by a coolant-conducting channel. This known heat transmission unit is a multi-part pressure-gas cooler with several planes of division.

In such heat exchange units, there are desired both a high efficiency with respect to the heat which is to be transmitted, as well as a lowest possible sooting. At the same time, it is desired that the pressure loss via the heat transmission units be kept as low as possible.

The known heat transmission units, particularly in case of small throughputs and temperature differences, have merely low cooling performances and cooling efficiencies. Particularly in the region of exhaust-gas recirculation, however, it can be desirable—for further reduction of pollutant emissions—to obtain a high cooling performance with low pressure loss in cases of large throughputs and small throughputs alike.

Thus, it is an object of the invention to provide a heat transmission unit by which, while keeping the pressure loss at a minimum, high cooling performances and respectively cooling efficiencies can be obtained over a large range of throughputs and temperatures.

SUMMARY OF THE INVENTION

The above object is achieved by said channel conducting the fluid to be cooled comprises a fluid inlet and a fluid outlet, and said channel is separated, by a partition wall arranged in flow direction, into a first and a second partial channel having a first partial inlet for fluid and a second first partial inlet for fluid as well as a first partial outlet for fluid and a second partial outlet for fluid, at least said first partial inlet for fluid being adapted to be shut off by a first shut-off means.

In this manner, there is provided a two-stage heat transmission unit which, even in case of small throughputs and relatively small temperature differences from the coolant, is still adapted to obtain a high cooling performance and cooling efficiency, respectively, since the reduced cross section for the passage of the flow will result in a high flow speed through the cooler.

In a preferably embodiment the heat transmission unit further comprises a wall separating the fluid inlet from the fluid outlet and extending to a position before an end of the heat transmission unit opposite to the fluid inlet and respectively the fluid outlet, so that at least, in the opened condition of said first shut-off means, the heat transmission unit is conducting a U-shaped flow. Such a configuration reduces the required axial dimension of the heat transmission unit so that the latter can be built in a smaller size.

Preferably, two shut-off means are arranged in the heat transmission unit wherein, in the closed condition of the first partial inlet for fluid as effected by the first shut-off means, the second shut-off means is switched to the effect that the cooling path for the fluid in the heat transmission unit is lengthened. This means that the shut-off means are arranged in such a manner that the heat transmission unit, via the second shut-off means, is partly conducting liquid therethrough in the opposite direction. This will result in a further extension of the effective cooling path and thus in a further increase of the efficiency in case of small throughputs and temperatures while, in the opened condition of the shut-off means, the same efficiencies with merely small pressure losses are obtained when compared to the state of the art.

According to a further embodiment, the heat transmission unit includes two partition walls arranged to cooperate with the shut-off means in such a manner that the whole channel will be conducting a liquid flow in both switch positions of the shut-off means, with the cooling path being lengthened while the cross section is narrowed. Thus, in both switch positions of the shut-off means, use will be made of the whole available cross section of the heat transmission unit, again with the result of an increased efficiency.

Preferably, in this regard, the cooling path will be lengthened by the same extent in which the fluid-conducting cross section is reduced. This means that a reduction of the fluid-conducting cross section to half of its original dimension will result in twice the original cooling path. This effect can be obtained by use of the whole heat transmission unit in both switch positions of the shut-off means, and by multiple deflection.

The use of the whole available heat transmission surface in both switch positions of the shut-off means for increasing the efficiency, is accomplished particularly by a heat transmission unit wherein the first partition wall extends, in the main flow direction and between the first and second partial inlets for fluid, from the fluid inlet into the heat transmission unit all the way to a position before the end opposite to the fluid inlet, and the second partition wall extends, in the main flow direction and between the first and second partial outlets for fluid, from the fluid outlet into the heat transmission unit all the way to a position before the end opposite to the fluid outlet, wherein the first and second shut-off means are formed as flaps and the flaps are arranged on the opposite ends of the heat transmission unit respectively between the first and second partition walls, the flaps being arranged vertically relative to each other in both switch directions. By such a configuration, there is generated a cooler wherein, in the closed condition of the first fluid inlet, the flow-conducting cross section is doubled while the cooling path is doubled at the same time. Thus, in the closed condition of the first flap, the fluid which is to be cooled will flow via the narrowed cross section into the heat transmission unit and, behind the first partition wall, will be deflected by 180° due to the closed position of the second shut-off means, then will again be deflected by 180° behind the intermediate wall and undergo the same process behind the second partition wall. Only here, the exhaust gas is allowed to be discharged.

By way of alternative, the first partition wall extends, in the main flow direction and between the first and second partial inlets for fluid, along a U-shaped path from the fluid inlet all the way to a position before the second partial outlet for fluid, and the second partition wall extends, in the main flow direction and between the first and second partial outlets for fluid, along a U-shaped path from the fluid outlet all the way to a position before the first partial inlet for fluid, wherein the first and second shut-off means are formed as flaps, the first flap being adapted to close the first partial inlet for fluid and the second being adapted to close the second partial outlet for fluid, and the processes of opening and closing the flaps being performed in parallel to each other. In a configuration of the above type, the flow-conducting cross section in the closed condition of the first partial inlet for fluid is reduced to a third and the cooling path is made three times as long; as a result, even in case of still smaller throughputs and respectively fluid mass flows, there is obtained a very good cooling effect due to the long cooling path existing, and due to the small cross section. Further, in the opened condition of the first partial inlet for fluid, the pressure loss occurring throughout the cooler can be kept low.

Particularly when using a heat transmission unit of the above configuration in an internal combustion engine for cooling exhaust gases, high cooling efficiencies are obtained independently of the throughput, the given temperature range of the exhaust gas flowing through the heat transmission unit, or the fluid. In case of high throughputs or high temperatures, a high cooling performance with low pressure losses can be guaranteed. Thus, the working range of such a cooler is increased.

Three alternative embodiments of heat transmission units according to the invention are illustrated in the drawings and will be described hereunder.

DETAILED DESCRIPTION OF PREFERRED EMBODIMENTS OF THE INVENTION

Figure 1:
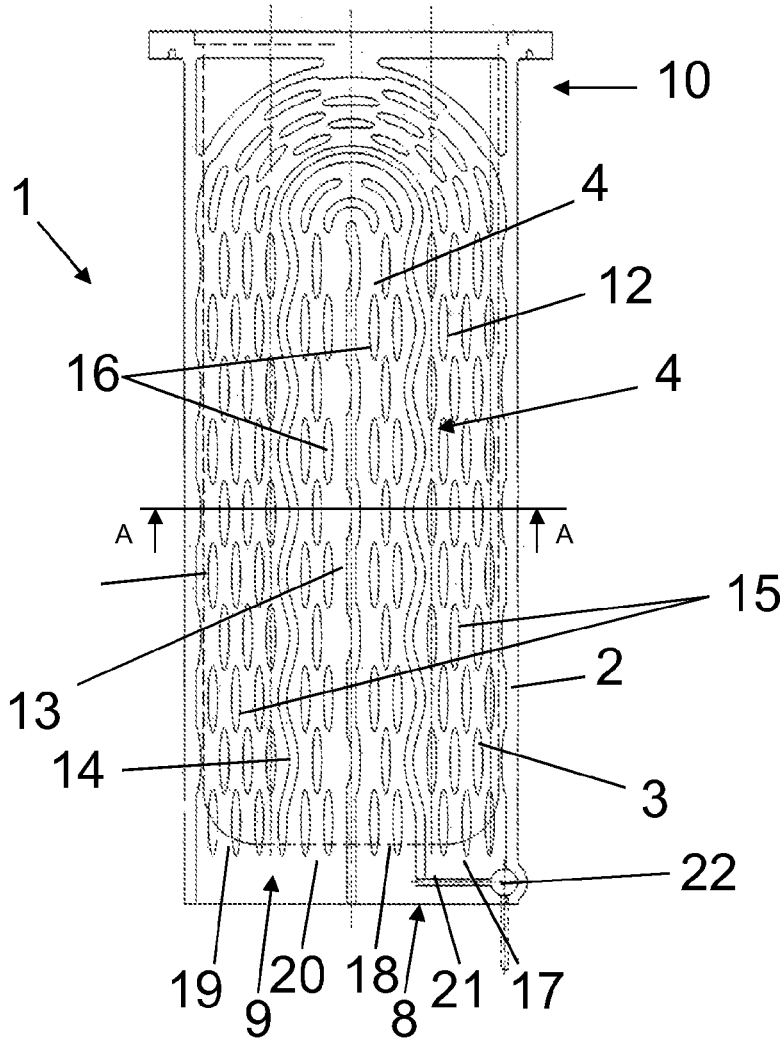
FIG. 1 is a sectional plan view of a first embodiment of a heat transmission unit of the invention.

Functionally equivalent components of the various embodiments of the heat transmission units of the invention will be provided with identical reference numerals throughout the following description.

Figure 2:
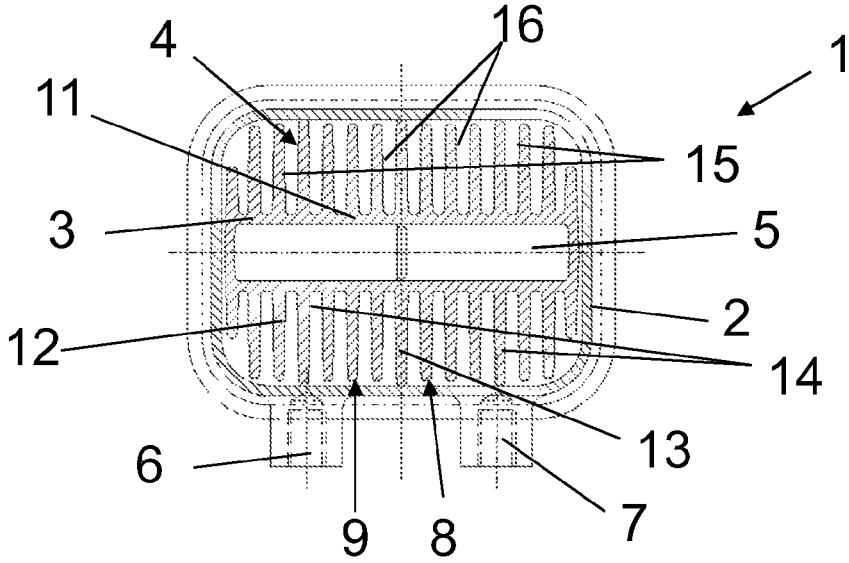
FIG. 2 is a sectional view of the heat transmission unit of FIG. 1, taken along line A-A in FIG. 1.

Illustrated in FIGS. 1 and 2 is a first embodiment of a heat transmission unit 1 of the invention which is preferably used as an exhaust-gas heat exchanger in motor vehicles. Heat transmission unit 1 comprises an outer casing 2 accommodating an inner casing 3 which can be produced e.g. by a pressure molding method. Upon assembly, a channel 4 for conducting the to-be-cooled fluid therethrough is formed between inner casing 3 and outer casing 2. Within inner casing 3, a channel 5 for conducting the coolant therethrough is arranged; in the present embodiment, the inlet and outlet connectors 6 and 7 of channel 5, which are shown in FIG. 2, are arranged at an end 10 of the heat transmission unit 1 opposite to a fluid inlet 8 and a fluid outlet 9. Said coolant-conducting channel 5 is delimited by a wall 11 continuously surrounding the channel when viewed in cross section and having ribs 12 extending therefrom into said channel 4 conducting the fluid to be cooled. Said channel 4 conducting the to-be-cooled fluid is arranged in such a manner that its fluid inlet 8 is located at the same end side as fluid outlet 9 so that the to-be-cooled fluid will be deflected by 180° on the opposite end. In correspondence thereto, the ribs 12 in this region are arranged to follow the main flow direction.

To effect a U-shaped throughflow as described above, it is required that, between fluid inlet 8 and fluid outlet 9, there is arranged a wall 13 extending along the flow direction into the channel 4 conducting the to-be-cooled fluid; said wall 13 ends at a distance from that end 10 of heat transmission unit 1 that is located opposite inlet 8, which distance substantially corresponds to the width of fluid inlet 8 and respectively fluid outlet 9 so that no flow losses will occur but merely a reversal of direction of the fluid at this end 10. This wall 13 has such a height that the wall extends to outer casing 2, thus preventing a transverse flow and overflow directly from inlet 8 to outlet 9.

As evident particularly from FIG. 1, the ribs 12, when viewed in the main flow direction, are arranged in respective rows located side by side to each other wherein, adjacent to a first row, there follows a respective second row whose ribs 12 are arranged at a displacement relative to the ribs 12 of the first row. Such an arrangement of the ribs 12 is effective to increase the dwelling time of the fluid in the heat transmission unit and thus the efficiency of the latter because the to-be-cooled fluid has no possibility anymore to perform a linear, unobstructed throughflow.

According to the invention, the heat transmission unit 1 further comprises a first partition wall 14 extending in a U-shaped configuration from fluid inlet 8 via end 10 to fluid outlet 9. In the present embodiment, this partition wall 14 divides the channel 4 into two partial channels 15 and 16, and thus also the fluid inlet 8 and the fluid outlet 9 into two identically sized partial inlets 17,18 for fluid and two partial outlets 19,20 for fluid. The first partial inlet 17 for fluid is controlled by a shut-off means 21 formed as a flap whose rotational axis 22 is arranged, according to the present embodiment, along a virtual extension of outer casing 2. Of course, both the shut-off means 21 and the partition wall 14 extend along the full height of heat transmission unit 1.

When using the above heat transmission unit 1 as an exhaust-gas cooler, an exhaust-gas recirculation valve is normally provided upstream of heat transmission unit 1, allowing the supply of varying fluid mass flows or exhaust-gas mass flows to heat transmission unit 1. Particularly in case of small exhaust-gas mass flows and small temperature differences between the exhaust gas and the coolant, the cooling performance of a heat transmission unit without partition wall 14 and shut-off means 21 is only quite low. In the present inventive embodiment of the heat transmission unit 1, the first partial inlet 17 for fluid is closed by the shut-off means 21, so that the whole mass flow will be flowing via the second partial inlet 18 for fluid to the second partial outlet 20 for fluid. For this flow, only half of the cross section is available as compared to a heat transmission unit 1 without a channel adapted to be shut off. Although the above arrangement does cause slightly higher pressure losses, the reduced throughput will still keep these pressure losses at a lower level than in case of the opened condition of shut-off means 21 and full throughput. Further, the cooling performance and thus the efficiency of heat transmission unit 1 are considerably increased as compared to known units with low throughput and reduced cross section. In situations of a correspondingly large fluid mass flow, shut-off means 21 will be opened, thus rendering the whole cross section of channel 4 available for cooling so that no too high pressure losses are generated and, at the same time, the known good cooling effect is obtained.

Figure 3:
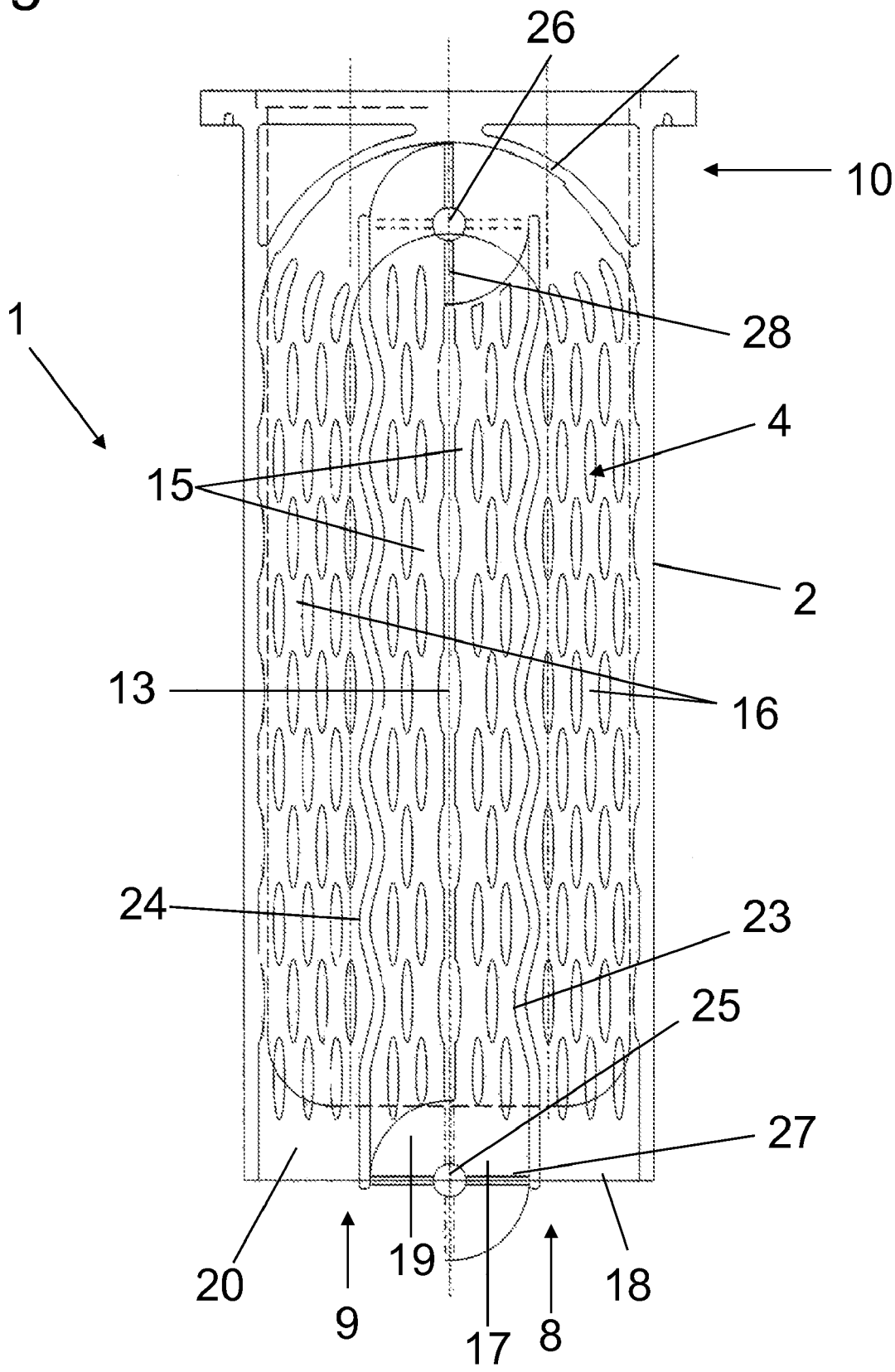
FIG. 3 is a plan view of an alternative embodiment of a heat transmission unit of the invention.

A further embodiment is illustrated in FIG. 3. In comparison with the first embodiment, the heat transmission unit 1 according to the further embodiment comprises two partition walls 23 and 24 internally thereof, the first partition wall 23 extending from fluid inlet 8 to the opposite end 10 of heat transmission unit 1, and the second partition wall 24 extending from fluid outlet 9 to the opposite end 10 of heat transmission unit 1. Both partition walls 23,24 end at a sufficient distance from end 10 so that, in the closed condition of one of the partial inlets 17,18 for fluid, a sufficient cross section for fluid throughflow is available behind the ends of partition walls 23,24 and between the partition walls 23,24 and the outer casing 2.

Between the respective ends of the two partition walls 23,24, rotational axes 25,26 are arranged in the extension of wall 13, each of the axes supporting a shut-off means formed as a flap 27,28. The width of the flaps 27,28 corresponds to the distance between the two partition walls 23,24. Further, the distance between the end of wall 13 and the rotational axes 25,26 corresponds respectively to half the width of such a flap 27,28, so that the first flap 27 in its first position will shut off the first partial inlet 17 for fluid as well as the first partial outlet 19 for fluid, while the second flap 28, when in its first end position, is arranged at a displacement of 90° relative to the first flap 27 and thus, in its width, is by one of its ends in abutment on wall 13 and is by its other end in abutment on outer casing 2. When in its second position, the first flap 27 is by both of its ends in abutment on partition walls 23 and 24.

Now, if the first shut-off means 27 is in a position of abutment on the two partition walls 23,24, the first partial inlet 17 for fluid is closed. Thus, the fluid mass flow will proceed, via the second partial inlet 18 for fluid, into partial channel 16 and will from there reach the opposite end 10 of heat transmission unit 1. The second shut-off means 28 is now effective, by its above mentioned first position, to prevent a fluid mass flow beyond the extension of wall 13. Consequently, the fluid mass flow is subjected to a deflection by 180° and, past partition wall 23, will enter partial channel 15 while, however, flowing through partial channel 15 in the opposite direction, i.e. in the direction leading to the first partial inlet 17 for fluid. In the process, a discharge flow is prevented due to the closed position of the first shut-off means 27, resulting in another reversal of the fluid mass flow into the region of the first partial channel 15 behind the first partial outlet 19, with the flow direction being thus again changed in comparison with the first embodiment or the opposite position of the flaps 27,28. The fluid will now again flow to the opposite end 10 where another reversal will occur towards the second partial outlet 20 via which the fluid is allowed to flow out.

Thus, in the above position of the flaps 27,28, there is generated a doubling of the total flow path covered, while the available flow cross section is reduced to half. Thereby, the cooling effect is distinctly increased because, in each condition, the totality of the available heat exchange surface will be used.

Thus, in the opposite position of the two shut-off means 27,28, the outer surface of the first flap 27 is arranged in the extension of wall 13 so that both partial inlets 17,18 for fluid are open. Consequently, the fluid flows from the fluid inlet 8 into both partial channels 15,16. The second flap 28 prevents a flow from partial channel 15 to partial channel 16 so that both channels 15,16 are conducting fluid in a U-shaped and parallel flow. Thus, the flow will pass from the first partial inlet 17 for fluid to the first partial outlet 19 for fluid, and from the second partial inlet 18, the fluid will flow to the second partial outlet 20 for fluid. Such a switch position is selected in case of large mass throughflow.

Figure 4:
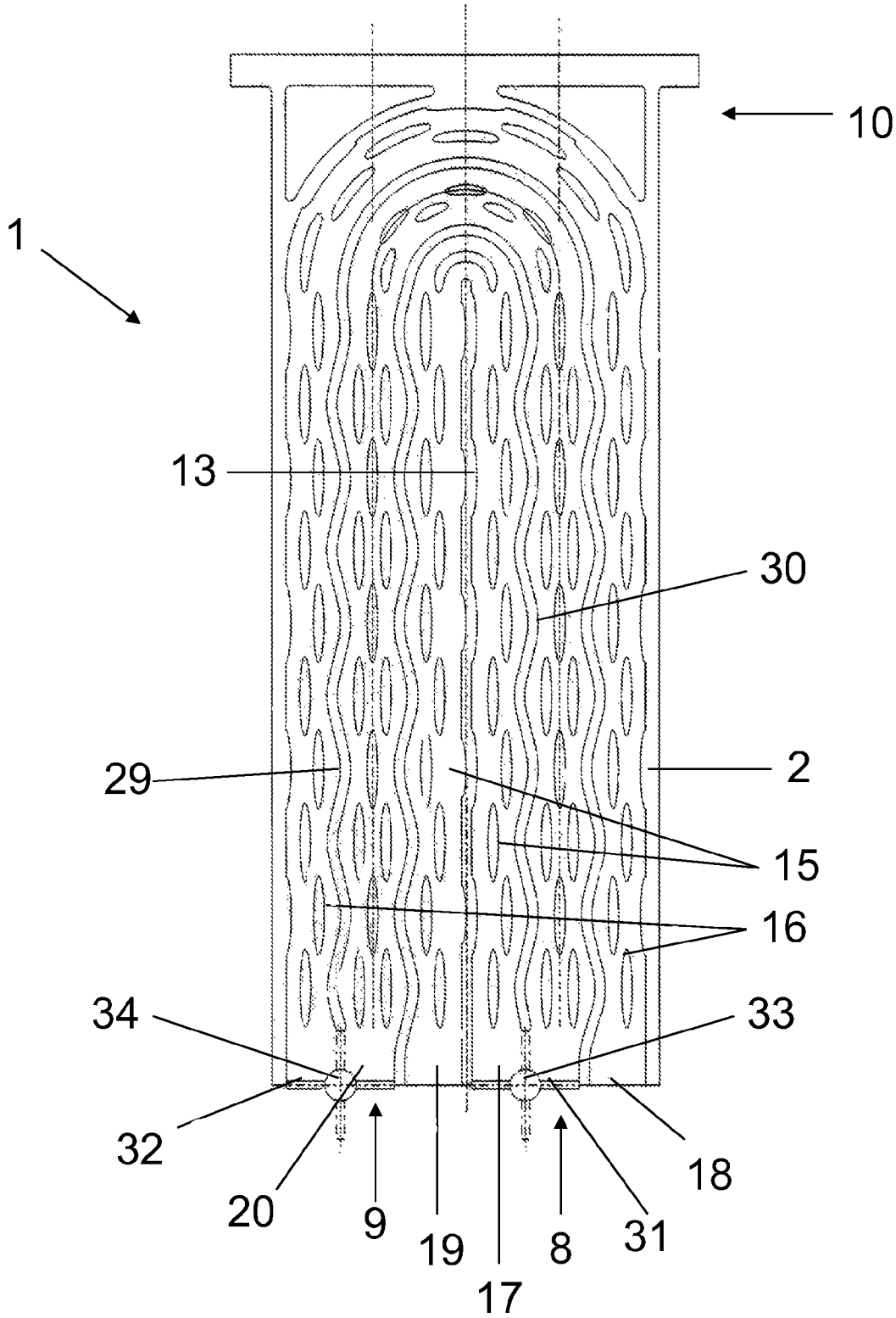
FIG. 4 illustrates a further alternative embodiment of a heat transmission unit of the invention, again shown in sectional plan view.

FIG. 4 shows a further alternative heat transmission unit 1, using again two partition walls 29,30 as well as two shut-off means 31,32. Here, however, the first partition wall 29 extends in a U-shaped configuration from fluid inlet 8 to fluid outlet 9 and ends at a distance from fluid outlet 9 which corresponds to half the width of shut-off means 32. However, the second partition wall 30, arranged in a U-shaped configuration parallel to that of first partition wall 29, extends from fluid outlet 9 in the direction toward fluid inlet 8 where it ends again at a distance from fluid inlet 8 that corresponds to half the width of shut-off means 31. These two partition walls 29,30 are arranged in such a manner that the fluid inlet 8 and the fluid outlet 9 are reduced to substantially a third of their cross section and their width, respectively.

The shut-off means 31,32 are mounted on rotational axes 33,34 which are arranged in the extension of the ends of the partition walls 29,30 in the region of the partial inlets 17,18 for fluid and respectively of the partial outlets 19,20 for fluid.

In the closed condition of the two flaps 31,32—i.e. in the condition of abutment of flap 31 on partition wall 29 and wall 13, and of abutment of flap 32 on partition wall 30 and outer casing 2—the fluid mass flow will enter the heat transmission unit 1 via the second partial inlet 18 and will stream along a U-shaped path between the outer casing 2 and the first partition wall 29, until reaching the second shut-off means 32 where the flow will be deflected behind the first partition wall 29 and will then again stream along a U-shaped path in the opposite direction between partition walls 29 and 30 towards the first partial inlet 17. When the flow reaches the first partial inlet 17, the path is blocked again by the shut-off means 31, causing a reversal behind partition wall 30, with the fluid mass flow now streaming between wall 13 and partition wall 30 along a U-shaped path in the direction of the first partial outlet 19 for fluid. Thus, there is generated a tripling of the cooling path while the available cross section is reduced to a third.

In the open condition of the shut-off means 31,32, i.e. in a position where the flaps are arranged along the extension of the partition walls 29,30, the usual fluid mass flow will take place along a U-shaped path from fluid inlet 8 to fluid outlet 9 over the whole cross section, thus reliably preventing excessive pressure losses in cases of high throughputs.

It should be apparent that such a configuration is not restricted to the above exemplary embodiments but that the constructional design of the cooler can be freely selected within a wide range. Thus, for instance, it would of course also be possible to arrange the fluid inlet and the fluid outlet on opposite ends of the heat transmission unit. Further, there can of course be provided an arrangement wherein the coolant is guided to flow around the heat transmission unit instead of within it. What is essential is the possibility to shut off a part of the available cross sectional area while nonetheless, if possible, the whole available heat-exchanger surface should be used. The shut-off means can be provided in the form of flaps but be realized also by other suitable elements. Further, it should be apparent that a heat transmission unit is not restricted to a heat transmission unit of the type which can be produced by pressure molding but that the above configuration of heat transmission units with variable cross section can be realized also in heat transmission units of different designs.

The described embodiments of the heat transmission unit can be used with very good cooling performances and cooling efficiencies over a large range of throughputs and temperatures. At the same time, the pressure loss occurring via the cooler is kept at a minimum.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A heat transmission unit comprising a single channel (5) conducting a coolant, and a channel (4) conducting a fluid to be cooled, said two channels being separated from each other by a single wall (11) provided with ribs extending therefrom into at least one of said two channels, wherein said channel (4) conducting the fluid to be cooled comprises a fluid inlet (8) and a fluid outlet (9), and said channel (4) is separated, by a partition wall (14;23,24;29,30) arranged in a flow direction, into a first and a second partial channel (15,16) having a first partial inlet (17) for fluid and a second partial inlet (18) for fluid as well as a first partial outlet (19) for fluid and a second partial outlet (20) for fluid, at least said first partial inlet (17) for fluid being adapted to be shut off by a first shut-off means (21;27;31), and wherein the first and the second partial channel (15,16) are separated from the single channel (5) conducting the coolant by the single wall (11), wherein the heat transmission unit (1) further comprises a wall (13) separating the fluid inlet (8) from the fluid outlet (9) and extending to a position before an end (10) of the heat transmission unit (1) opposite to the fluid inlet (8) and respectively the fluid outlet (9), so that, in the opened condition of said first shut-off means (21;27;31), the heat transmission unit (1) is conducting a U-shaped flow, and either, 1) wherein a first partition wall (23) extends, in a main flow direction and between the first and second partial inlets (17,18) for fluid, from the fluid inlet (8) into the heat transmission unit (1) to a position before the end (10) opposite to the fluid inlet (8), and a second partition wall (24) extends, in the main flow direction and between the first and second partial outlets (19,20) for fluid, from the fluid outlet (9) into the heat transmission unit (1) to a position before the end (10) opposite to the fluid outlet (9), wherein the first and second shut-off means (27,28) are formed as flaps and the flaps (27,28) are arranged on the opposite ends of the heat transmission unit (1) respectively between the first and second partition walls (23,24), the flaps (27, 28) being arranged vertically relative to each other in both switch directions, or 2) wherein a first partition wall (29) extends, in a main flow direction and between the first and second partial inlets (17,18) for fluid, along a U-shaped path from the fluid inlet (8) to a position before the second partial outlet (20) for fluid, and a second partition wall (30) extends, in the main flow direction, along a U-shaped path from the fluid outlet (9) between the first and second partial outlets (19,20) for fluid, all the way to a position before the first partial inlet (17) for fluid, wherein the first and second shut-off means (31,32) are formed as flaps, the first flap (31) being adapted to close the first partial inlet (17) for fluid and the second flap (32) being adapted to close the second partial outlet (20) for fluid, and the processes of opening and closing the flaps (31,32) being performed in parallel to each other.

2. The heat transmission unit of claim 1, wherein the heat transmission unit (1) is provided with two shut-off means (27,28;31,32) arranged internally thereof and wherein, in the closed condition of the first partial inlet (17) for fluid as effected by the first shut-off means (27;31), the second shut-off means (28;32) is switched in such a manner that a cooling path for the fluid in the heat transmission unit (1) is lengthened.

3. The heat transmission unit of claim 2, wherein the heat transmission unit (1) comprises two partition walls (23,24;29,30) cooperating with the two shut-off means (27,28;31,32) in such a manner that the whole channel (4) is in a flow-conducting state in both switch positions of the two shut-off means (27,28;31,32), the cooling path being lengthened and a cross section being narrowed.

4. The heat transmission unit of claim 3, wherein the cooling path is lengthened substantially to the same extent to which the cross section is reduced.

* * * * *